US012121196B2

(12) United States Patent
Lee et al.

(10) Patent No.: US 12,121,196 B2
(45) Date of Patent: Oct. 22, 2024

(54) DISHWASHER

(71) Applicant: SAMSUNG ELECTRONICS CO., LTD., Suwon-si (KR)

(72) Inventors: Changwook Lee, Suwon-si (KR); Eunseok Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 215 days.

(21) Appl. No.: 17/682,303

(22) Filed: Feb. 28, 2022

(65) Prior Publication Data

US 2022/0183535 A1 Jun. 16, 2022

Related U.S. Application Data

(63) Continuation of application No. PCT/KR2020/008533, filed on Jun. 30, 2020.

(30) Foreign Application Priority Data

Aug. 29, 2019 (KR) ..... 10-2019-0106593

(51) Int. Cl.
*A47L 15/42* (2006.01)

(52) U.S. Cl.
CPC ..... *A47L 15/4263* (2013.01); *A47L 15/421* (2013.01)

(58) Field of Classification Search
CPC . A47L 15/4263; A47L 15/421; A47L 15/4246
See application file for complete search history.

(56) References Cited

U.S. PATENT DOCUMENTS 6,536,451 B2 * 3/2003 Hechtl ..... A47L 15/4263 134/201
2015/0123524 A1 * 5/2015 Ser ..... A47L 15/4263 49/506

FOREIGN PATENT DOCUMENTS

| | | | | |
|---|---|---|---|---|
| CN | 201346193 Y | * | 11/2009 | |
| CN | 107981819 A | * | 5/2018 | A47L 15/4263 |
| DE | 102010063109 A1 | * | 6/2012 | A47L 15/4263 |
| DE | 10 2011 004 087 A1 | | 8/2012 | |
| DE | 102011004085 A1 | * | 8/2012 | |
| DE | 102011004088 A1 | * | 8/2012 | A47L 15/4212 |
| DE | 102011004089 A1 | * | 8/2012 | A47L 15/4263 |
| DE | 102012202264 A1 | * | 8/2013 | A47L 15/4263 |
| EP | 1 281 345 A1 | | 7/2001 | |
| EP | 2486840 A2 | * | 8/2012 | A47L 15/4212 |

(Continued)

OTHER PUBLICATIONS

Extended European Search Report dated Aug. 29, 2022 in European Patent Application No. 20856358.5 (9 pages).

(Continued)

*Primary Examiner* — Hanh V Tran
(74) *Attorney, Agent, or Firm* — STAAS & HALSEY LLP

(57) ABSTRACT

A dishwasher including a main body; a tub provided inside the main body to form a washing space; a door configured to open and close the tub, and including an inner door located inside the tub while the tub is closed by the door; a sealing member provided at a lower end of the inner door, and configured to prevent leakage from occurring between a bottom plate of the tub and the inner door; and a cover member provided at the lower end of the inner door and to cover a gap between the lower end of the inner door and the tub.

11 Claims, 12 Drawing Sheets

(56) References Cited

FOREIGN PATENT DOCUMENTS

| | | | | | |
|---|---|---|---|---|---|
| EP | 2 224 840 | B1 | | 11/2014 | |
| EP | 2 486 840 | B1 | | 10/2018 | |
| JP | 3049214 | U | | 6/1998 | |
| JP | 2001-292948 | A | | 10/2001 | |
| KR | 20-0215082 | Y1 | | 3/2001 | |
| KR | 20-0269246 | Y1 | | 3/2002 | |
| KR | 10-2008-0071352 | | | 8/2008 | |
| KR | 20080071352 | A | * | 8/2008 | |
| KR | 20150052610 | A | * | 5/2015 | |
| KR | 10-2016-0142020 | A | | 12/2016 | |
| KR | 20170140623 | A | * | 12/2017 | |
| KR | 10-2018-0060506 | | | 6/2018 | |
| KR | 10-2018-0060506 | A | | 6/2018 | |
| KR | 20180060506 | A | * | 6/2018 | |
| WO | WO-2009083350 | A1 | * | 7/2009 | ..... A47L 15/4263 |
| WO | 2010/133514 | A1 | | 11/2010 | |
| WO | WO-2020159124 | A1 | * | 8/2020 | |

OTHER PUBLICATIONS

International Search Report for International Patent Application No. PCT/KR2020/008533 dated Oct. 30, 2020.
International Written Opinion for International Patent Application No. PCT/KR2020/008533 dated Oct. 30, 2020.
Korean Office Action issued in counterpart Korean Application No. 10-2019-0106593 dated Jun. 11, 2024.
European Intention to Grant issued in counterpart European Application No. 20 856 358.5m dated Jun. 24, 2024.

* cited by examiner

DISHWASHER

CROSS-REFERENCE TO RELATED APPLICATION

This application is a Continuation Application, under 35 U.S.C. § 111(a), of PCT Application No. PCT/KR2020/008533, filed on Jun. 30, 2020, which claims the priority benefit under 35 U.S.C. § 119 of Korean Application No. 10-2019-0106593, filed Aug. 29, 2019, the contents of both of which are incorporated by reference herein in their entirety.

BACKGROUND

1. Field

The disclosure relates to a dishwasher, and more particularly, to a dishwasher having a leakage prevention structure.

2. Description of the Related Art

A dishwasher is an appliance for washing off waste such as food residues on dishes, cooking tools, etc. (hereinafter, collectively referred to as a 'washing material') with a detergent and washing water.

Generally, the dishwasher includes a tub providing a washing space, a door provided on a front side of the tub to open and close the washing space, a dish rack included in the tub and accommodating a washing material therein, a spray arm for spraying washing water toward the dish rack, a sump storing washing water, and a supply flow path for supplying the washing water stored in the sump to the spray arm.

Meanwhile, the door of the dishwasher rotates with respect to a hinge provided at the lower end to open and close the washing space. Therefore, a gap is made between the door and the bottom of the tub, and washing water may leak out through the gap when a washing process is performed.

SUMMARY

A dishwasher according to a concept of the disclosure includes: a main body; a tub provided inside the main body to form a washing space; a door configured to open and close the tub, and including an inner door located inside the tub while the tub is closed by the door; a sealing member provided at a lower end of the inner door, and configured to prevent leakage from occurring between a bottom plate of the tub and the inner door; and a cover member provided at the lower end of the inner door and to cover a gap between the lower end of the inner door and the tub.

The lower end of the inner door may include a side panel formed to face a side surface of the tub, and the cover member coupleable to the side panel of the lower end of the inner door.

The lower end of the inner door may further include: a first flange formed to face the bottom plate of the tub; and a second flange formed to extend upward from the first flange.

The sealing member may include: a first sealing portion coupleable to the second flange; and a second sealing portion formed to be bent upward from the first sealing portion, and seal a gap between the bottom plate of the tub and the second flange.

The second flange may include a first hole, and the second sealing portion may include a second hole formed at a location corresponding to the first hole.

The first sealing portion may include: a first seal formed to extend along the second flange, and coupleable to one side of the second flange; and a second seal formed to extend from one end of the first seal to face the first flange, and including a guide rib adhered to another side of the second flange.

The cover member may include: a body portion to be positioned between the first flange and the second flange; a first cover portion to be connected to the body portion, formed to extend upward, and coupleable to the side panel; and a second cover portion to be connected to one side of the body portion, coupleable to the first flange, and positioned between the bottom plate of the tub and the first flange.

An opening to accommodate an end of the side panel may be formed at an upper end of the first cover portion.

The first cover portion may include: a first plate; a second plate formed to face the first plate; and a third plate provided between the first plate and the second plate.

The first flange may include a coupling hole, and a protrusion for coupling with the coupling hole may be formed on a surface of the second cover portion, the surface formed to face the first flange.

The second cover portion may include a protrusion rib formed to be inserted and fixed between the first sealing portion and the second flange while the first sealing portion is coupled to the second flange.

The body portion may include: a first body member formed to be inserted between the first flange and the second flange; and a second body member having a narrower width than the first body member, and spaced a preset distance from the second flange.

The second cover portion may include a flexible material.

The second cover portion may be connected to one end of the body portion, and while connected form a preset angle with respect to the body portion.

The second cover portion may be connected to one end of the body portion, and while connected may extend in parallel to the body portion.

The cover member may further include an elastic member formed at a portion at which the second cover portion is connected to the body portion, wherein the second cover portion is maintained in parallel to the body portion by the elastic member.

A dishwasher according to a concept of the disclosure includes: a main body; a tub provided inside the main body to form a washing space; a door configured to open and close the tub, and including an inner door located inside the tub while the tub is closed by the door; a sealing member provided at a lower end of the inner door, and configured to prevent leakage from occurring between a bottom plate of the tub and the inner door; and a cover member of which one side is provided at a side panel of the inner door and of which another side is provided between a first flange and a second flange of the inner door to prevent leakage from occurring through a gap between the side panel and the first and second flanges.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
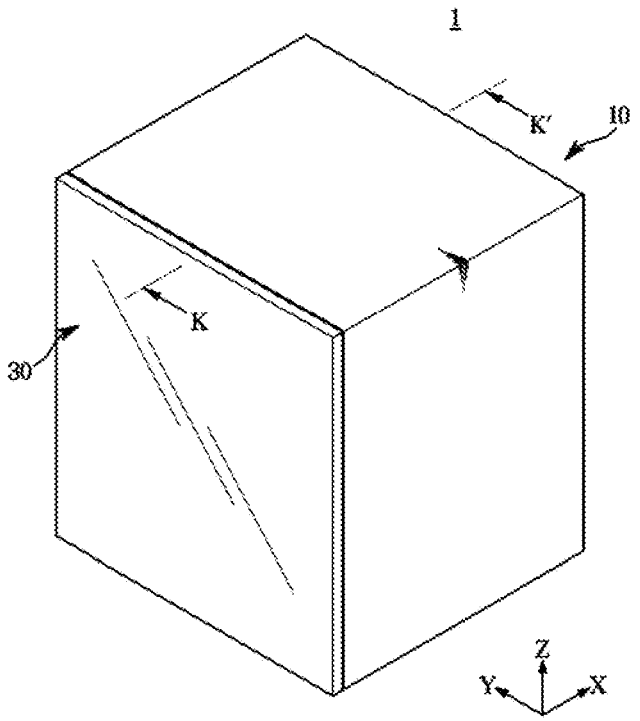
FIG. 1 is a perspective view showing a closed state of a door, in a dishwasher according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe embodiments, and are not intended to restrict and/or limit the disclosure. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

It will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the disclosure. As used herein, the term "and/or" includes any and all combinations of one or more of associated listed items.

It is an aspect of the disclosure to provide a dishwasher capable of preventing leakage of a tub.

It is another aspect of the disclosure to provide a dishwasher capable of preventing water from leaking out through a gap between a door and a tub.

Hereinafter, an embodiment of the disclosure will be described in detail with reference to the accompanying drawings.

Figure 2:
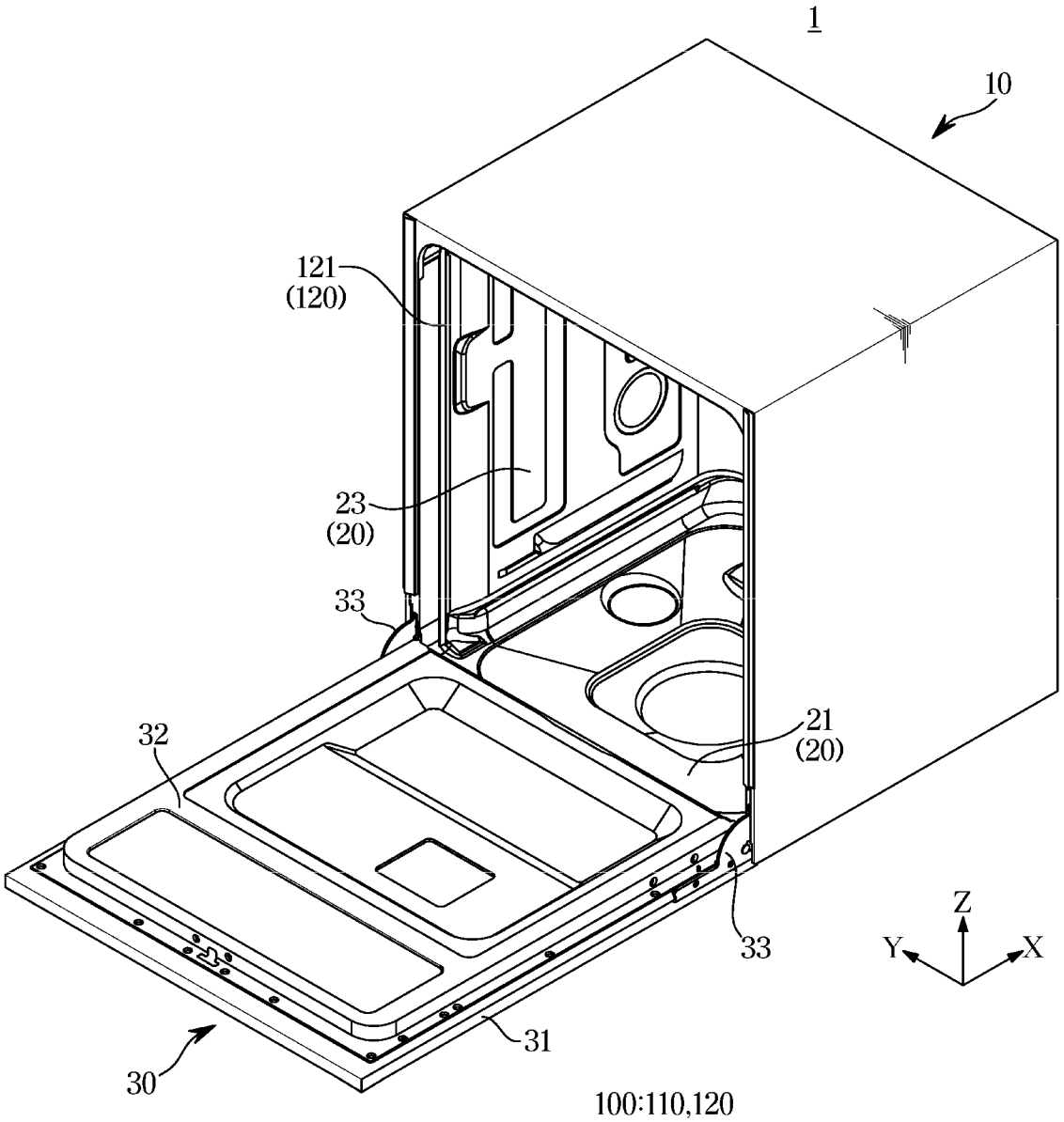
FIG. 2 is a perspective view showing an opened state of a door, in a dishwasher according to an embodiment of the disclosure.
Figure 3:
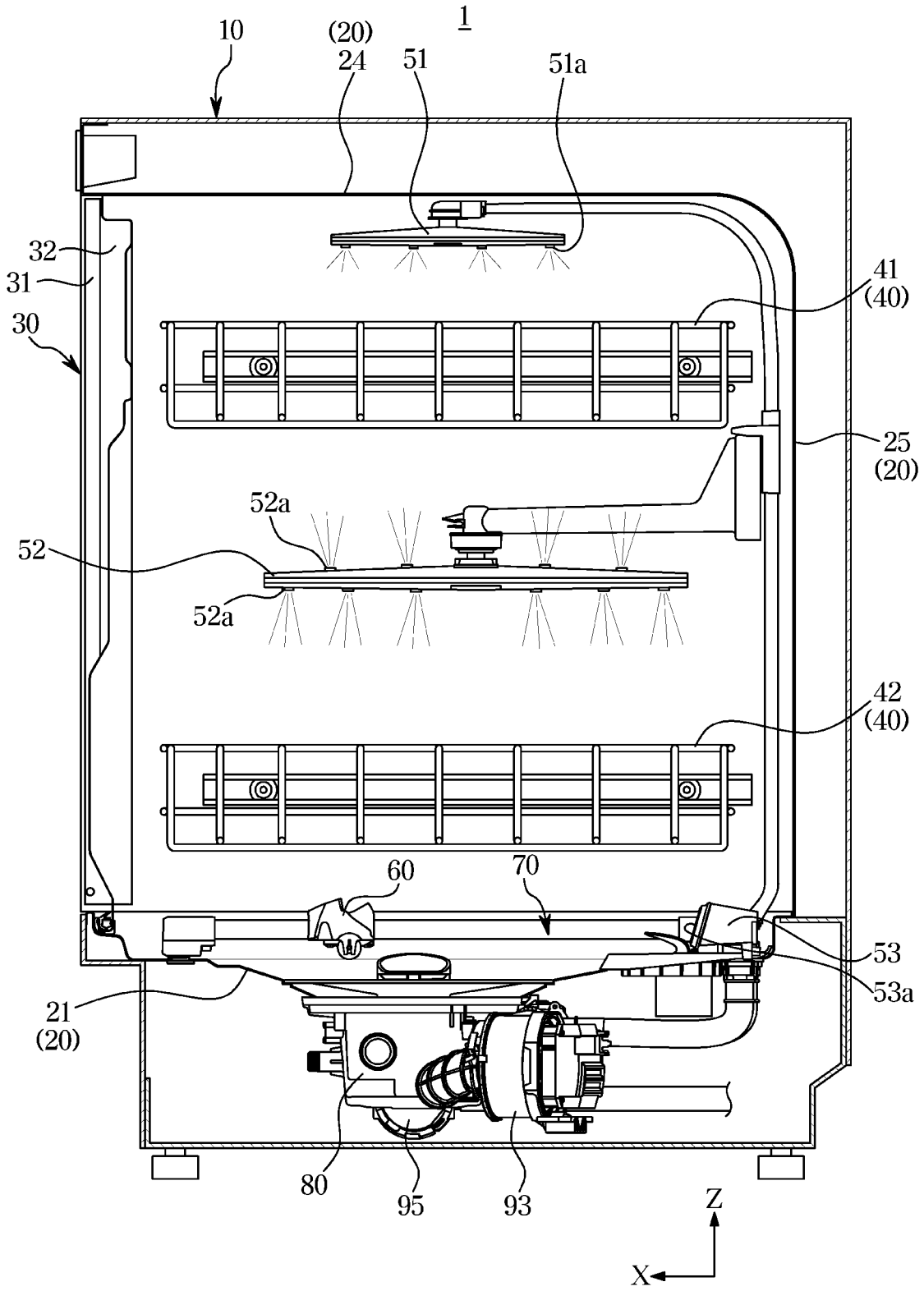
FIG. 3 is a cross-sectional view of the dishwasher shown in FIG. 1, taken along line K-K'.

FIG. 1 is a perspective view showing a closed state of a door, in a dishwasher according to an embodiment of the disclosure, FIG. 2 is a perspective view showing an opened state of a door, in a dishwasher according to an embodiment of the disclosure, and FIG. 3 is a cross-sectional view of the dishwasher shown in FIG. 1, taken along line K-K'.

As shown in FIGS. 1 to 3, a dishwasher 1 may include a main body 10 forming an outer appearance, a tub 20 provided inside the main body 10, and a door 30 for opening and closing the tub 20.

The tub 20 may be substantially in a shape of a box having an open front side through which dishes are put into or taken out of the tub 20. A front opening of the tub 20 may be opened or closed by the door 30.

The tub 20 may include a bottom plate 21, side walls, a upper wall 24, and a rear wall 25. The side walls may include a right wall (not shown) and a left wall 23.

The door 30 may be rotatably mounted on the main body 10 to open or close the tub 20. More specifically, the door 30 may be rotatably mounted on the main body 10 to open or close the open front side of the tub 20. The door 30 may be rotatably coupled with the main body 10 by a door bracket 33. Preferably, the door 30 may be rotatably coupled with the main body 10 by a pair of door brackets 33.

The door 30 may include an outer door 31 forming a front outer appearance of the dishwasher 1, and an inner door 32 coupled with the outer door 31 in such a way as to face the tub 20. That is, the inner door 32 may be coupled with an inner surface of the outer door 31.

The dishwasher 1 may further include a plurality of baskets 40 provided inside the tub 20 to accommodate dishes. The plurality of baskets 40 may be a wire rack made of wires that pass washing water without collecting the washing water therein. The plurality of baskets 40 may be detachably installed inside the tub 20. The plurality of baskets 40 may include a upper basket 41 positioned in an upper space of the tub 20, and a lower basket 42 positioned in a lower space of the tub 20.

The dishwasher 1 may further include a plurality of spray nozzles 51, 52, and 53 for spraying washing water. The plurality of spray nozzles 51, 52, and 53 may spray washing water at high pressure to wash dishes. The plurality of spray nozzles 51, 52, and 53 may include a upper rotating nozzle 51 provided in the upper space of the tub 20, a middle rotating nozzle 52 provided in a center space of the tub 20, and a fixed nozzle 53 provided in the lower space of the tub 20.

The upper rotating nozzle 51 may be provided above the upper basket 41, and spray washing water downward while rotating by water pressure. To spray washing water downward, a plurality of spray holes 52*a* may be formed in a lower end of the upper rotating nozzle 51. The upper rotating nozzle 51 may directly spray washing water toward dishes accommodated in the upper basket 41.

The middle rotating nozzle 52 may be positioned between the upper basket 41 and the lower basket 42, and spray washing water in an up-down direction while rotating by water pressure. To spray washing water in the up-down direction, a plurality of spray holes 52*a* may be formed in each of upper and lower ends of the middle rotating nozzle 52. The middle rotating nozzle 52 may directly spray washing water toward dishes accommodated in the upper basket 41 and the lower basket 42.

The fixed nozzle 53 may be immovable unlike the upper rotating nozzle 51 and the middle rotating nozzle 52, and fixed to one side of the tub 20. The fixed nozzle 53 may be positioned adjacent to the rear wall 25 of the tub 20 to spray washing water toward a front direction of the tub 20. Accordingly, washing water sprayed from the fixed nozzle 53 may not directly head toward dishes.

The washing water sprayed from the fixed nozzle 53 may be reflected toward the dishes by a vein 60. The fixed nozzle 53 may be positioned below the lower basket 42, and the vein 60 may reflect washing water sprayed from the fixed nozzle 53 upward. That is, washing water sprayed from the fixed nozzle 53 may be reflected toward dishes accommodated in the lower basket 42 by the vein 60.

The fixed nozzle 53 may have a plurality of spray holes 53*a* aligned in a left-right direction of the tub 20. The plurality of spray holes 53*a* may spray washing water toward the front direction.

The upper rotating nozzle 51 and the middle rotating nozzle 52 may be coupled with and fixed to the fixing nozzle 53.

The dishwasher 1 may further include the vein 60 moving inside the tub 20 and reflecting washing water toward the dishes, and a driving device 70 for driving the vein 60.

The vein 60 may extend in the left-right direction of the tub 20 to reflect all washing water sprayed from the plurality of spray holes 53*a* of the fixed nozzle 53. That is, one end in longitudinal direction of the vein 60 may be adjacent to the left wall 23 of the tub 20, and the other end in longitudinal direction of the vein 60 may be adjacent to the right wall of the tub 20.

The vein 60 may perform a linear reciprocating motion in a spray direction of washing water sprayed from the fixed nozzle 53. That is, the vein 60 may perform a linear reciprocating motion in a front-back direction of the tub 20. Accordingly, a linear spray structure including the fixed nozzle 53 and the vein 60 may wash the entire inside space of the tub 20 without making a blind spot.

The dishwasher 1 may further include a sump 80 storing washing water, a circulating pump 93 for pumping the washing water stored in the sump 80 to supply the pumped washing water to the plurality of spray nozzles 51, 52, and 53, and a drain pump 95 for discharging washing water collected in the sump 80 to outside of the main body 10 together with wastes.

The dishwasher 1 may further include a gasket 100 installed between the tub 20 and the door 30 to prevent leakage of washing water. That is, the dishwasher 1 may further include the gasket 100 for covering a gap between the tub 20 and the door 30 to prevent leakage of washing water. The gasket 100 may be made of an elastic material. For example, the elastic material may include rubber, silicon, and the like.

The gasket 100 may include a sealing member 110 positioned between a lower end of the door 30 and a lower end of the tub 20 to cover a gap between the lower end of the door 30 and the lower end of the tub 20. That is, the sealing member 110 may be positioned between the lower end of the door 30 and the bottom plate 21 of the tub 20 to cover the gap between the lower end of the door 30 and the lower end of the tub 20. Details about the sealing member 110 will be described below.

The gasket 100 may further include a packing member 120 installed to cover a gap between the door 30 and the tub 20, together with the sealing member 110. The packing member 120 may be installed on the tub 20 to cover the gap between the door 30 and the tub 20. More specifically, the packing member 120 may include a first packing member 121 installed on the side walls of the tub 20 to cover gaps between side ends of the door 30 and side ends of the tub 20, and a second packing member (not shown) installed on the upper wall 24 of the tub 20 to cover a gap between an upper end of the door 30 and a upper end of the tub 20.

Preferably, the first packing member 121 may extend from the side walls of the tub 20 to a portion of the bottom plate 21 being adjacent to the side walls of the tub 20. Preferably, the first packing member 121 and the second packing member may be integrated into one body. However, the first packing member 121 and the second packing member may be not integrated into one body as long as the first packing member 121 is connected to the second packing member. The first packing member 121 and the second packing member may be manufactured separately, and then the first packing member 121 may be coupled with the second packing member.

The dishwasher 1 may further include a cover member 200 for covering a gap between a lower end of the inner door 32 and the lower end of the tub 20 according to whether the inner door 32 is opened or closed, to prevent washing water from leaking out. The cover member 200 may complement the function of the gasket 100.

More specifically, the cover member 200 may prevent washing water moving in an unexpected direction while the dishwasher 1 operates from leaking out of the dishwasher 1.

Particularly, the cover member 200 may prevent leakage of washing water at a portion at which leakage of washing water is not prevented by the sealing member 110. For example, the cover member 200 may prevent washing water from leaking out between a side portion of the inner door 32 and the bottom plate 21 of the tub 20.

The cover member 200 may be coupled with the sealing member 110 and move together with the sealing member 110.

Preferably, the cover member 200 may be made of a flexible material. More preferably, the cover member 200 may be made of a flexible, elastic material. For example, the cover member 200 may be made of rubber, silicon, etc. The cover member 200 made of a flexible material may be easily adhered to the tub 20, and accordingly, the cover member 200 may effectively prevent washing water from leaking out of the dishwasher 1 according to closing of the door 30.

However, the material of the cover member 200 is not limited to the above-mentioned example as long as the cover member 200 is capable of covering the gap between the lower end of the inner door 32 and the lower end of the tub 20. For example, the cover member 200 may be made of a hard plastic material. Details about the cover member 200 will be described below.

Figure 4:
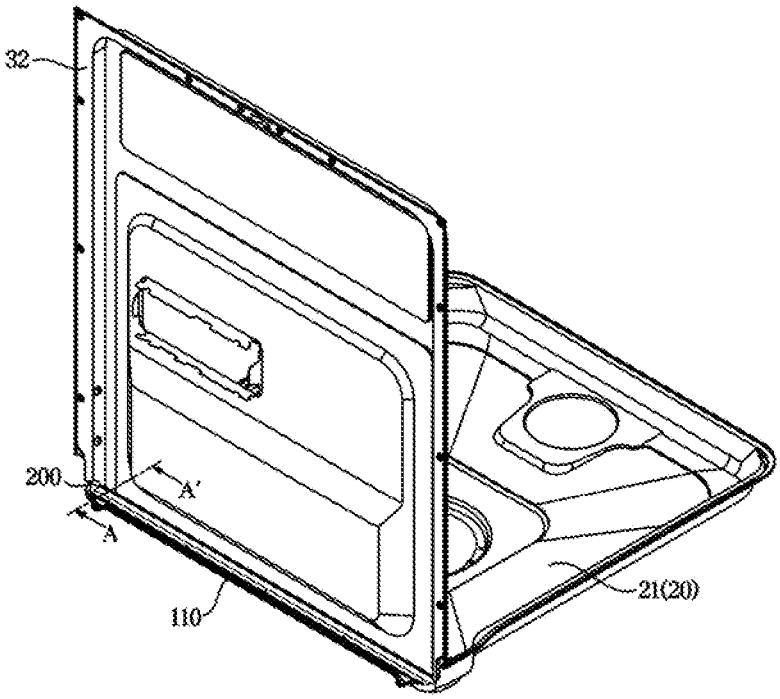
FIG. 4 is a perspective view showing a door, a bottom plate of a tub, a sealing member, and a cover member, in a dishwasher according to an embodiment of the disclosure.
Figure 5:
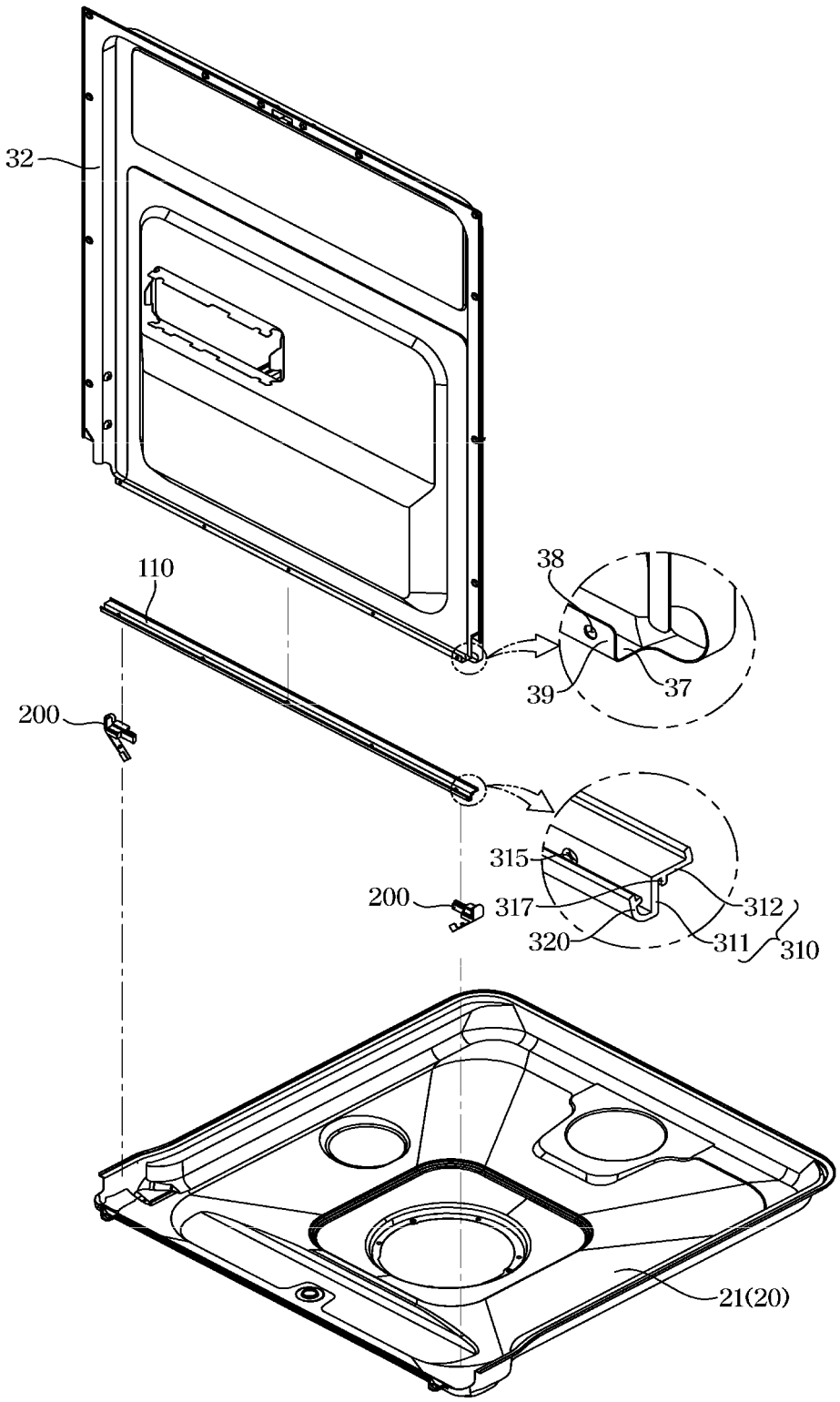
FIG. 5 is an exploded perspective view showing a coupling structure of the door, the bottom plate of the tub, the sealing member, and the cover member of FIG. 4.

FIG. 4 is a perspective view showing a door, a bottom plate of a tub, a sealing member, and a cover member, in a dishwasher according to an embodiment of the disclosure, and FIG. 5 is an exploded perspective view showing a coupling structure of the door, the bottom plate of the tub, the sealing member, and the cover member of FIG. 4.

Referring to FIGS. 4 and 5, in the dishwasher 1 according to an embodiment of the disclosure, the door 30 may open and close the tub 20, and the inner door 32 may be positioned inside the tub 20 upon closing of the tub 20 by the door 30. In this case, the sealing member 110 may be positioned at the lower end of the door 30 to seal between the inner door 32 and the bottom (the bottom plate 21) of the tub 20 and thereby prevent washing water stored in the tub 20 from leaking between the inner door 32 and the bottom plate 21 of the tub 20.

Furthermore, the cover member 200 may additionally cover the gap between the inner door 32 and the bottom plate 21 of the tub 20 to prevent leakage at a portion not sealed by the sealing member 110. In addition, the cover member 200 may cover a gap between the sealing member 110 and the lower end of the inner door 32 to effectively prevent washing water from leaking out.

More specifically, as shown in FIG. 4, the lower end of the inner door 32 may include a side panel 35, a first flange 37, and a second flange 39.

In a state in which the tub 20 is closed by the inner door 32, the side panel 35 may face the side surface of the tub 20, and the first flange 37 may extend along the lower end of the door 30 to face the bottom plate 21 of the tub 20. Also, the second flange 39 may extend upward from the first flange 37. In this case, the first and second flanges 37 and 39 may be integrated into one body, or may be manufactured separately and then coupled with each other.

In the lower end of the inner door 32, the first flange 37 and the second flange 39 may be formed, and the sealing member 110 and the cover member 200 may be coupled with the first and second flanges 37 and 39 to prevent washing water from leaking out.

The first and second flanges 37 and 39 may be used to be coupled with the sealing member 110 and the cover member 200, wherein the sealing member 110 may be coupled with the first and second flanges 37 and 39 to prevent leakage between the lower end of the inner door 32 and the bottom plate 21 of the tub 20, and the cover member 200 may be coupled with the first and second flanges 37 and 39 or positioned in a space formed by the first and second flanges 37 and 39 to prevent leakage through a gap between the lower end of the inner door 32 and the sealing member 110.

Meanwhile, a first hole 38 with which the sealing member 110 is coupled may be formed at one side of the second flange 39, and the first hole 38 will be described below.

Figure 6:
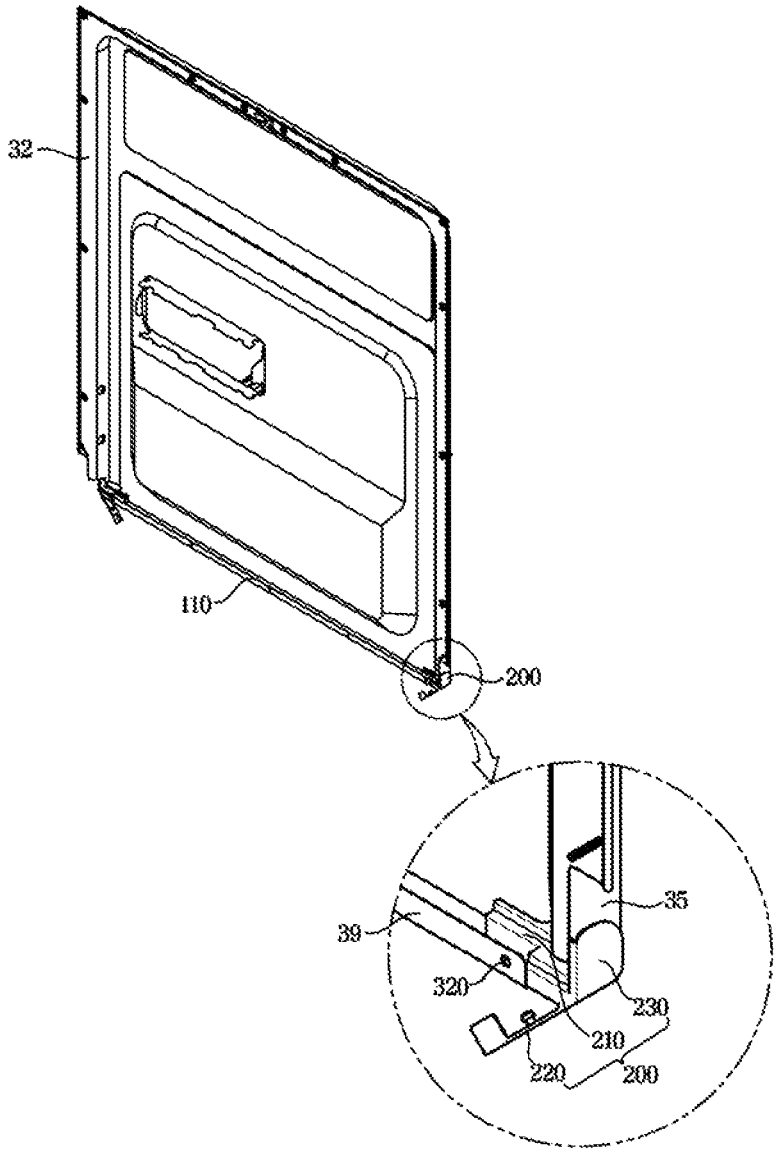
FIG. 6 is a perspective view showing a state in which the cover member of FIG. 4 is coupled with the door.
Figure 7A:
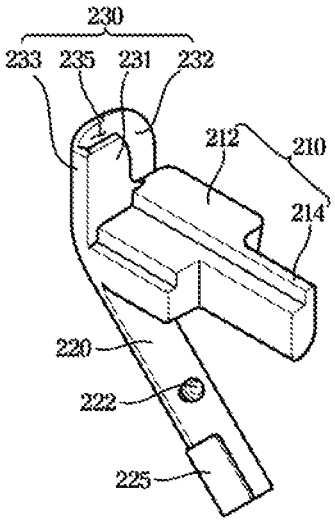
FIGS. 7A and 7B are enlarged perspective views showing the cover member of FIG. 4.
Figure 7B:
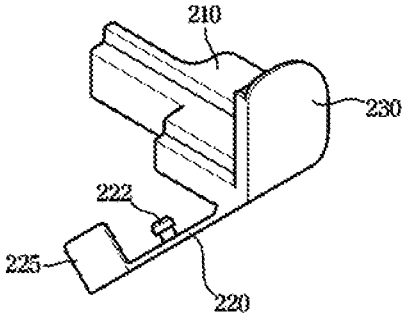
Figure 8:
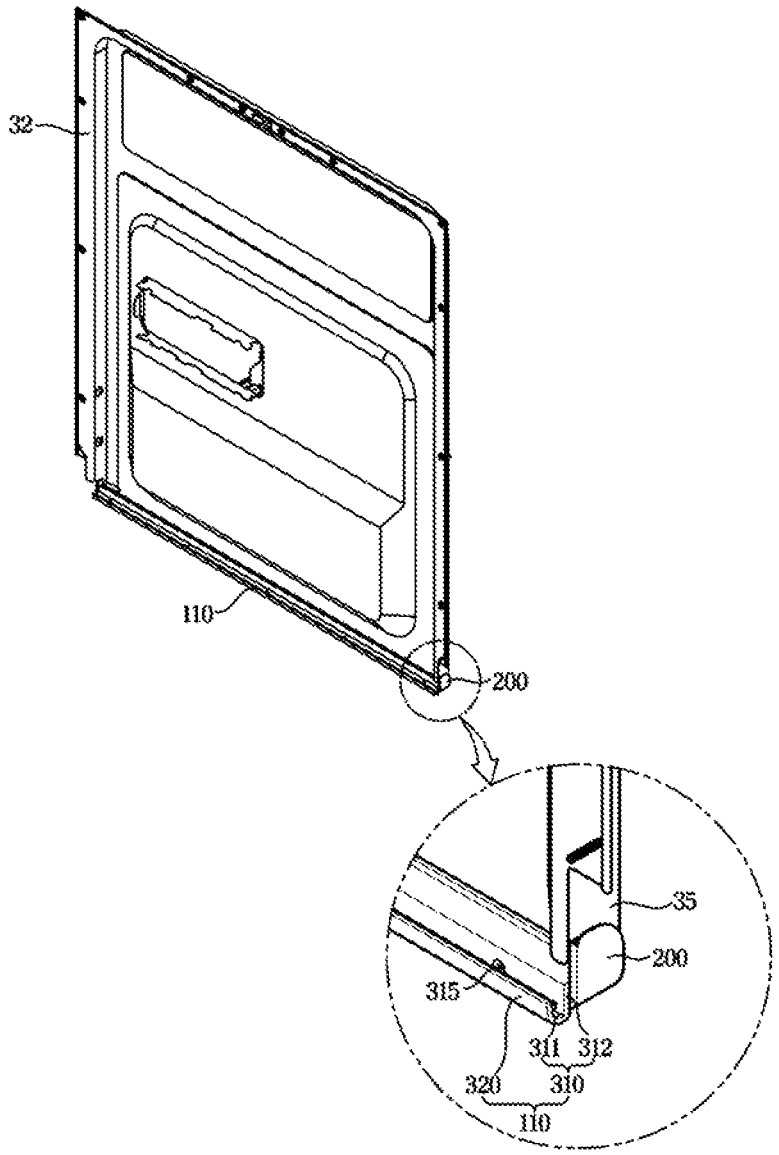
FIG. 8 is a perspective view showing a state in which a sealing member is coupled with a door coupled with the cover member of FIG. 6.
Figure 9:
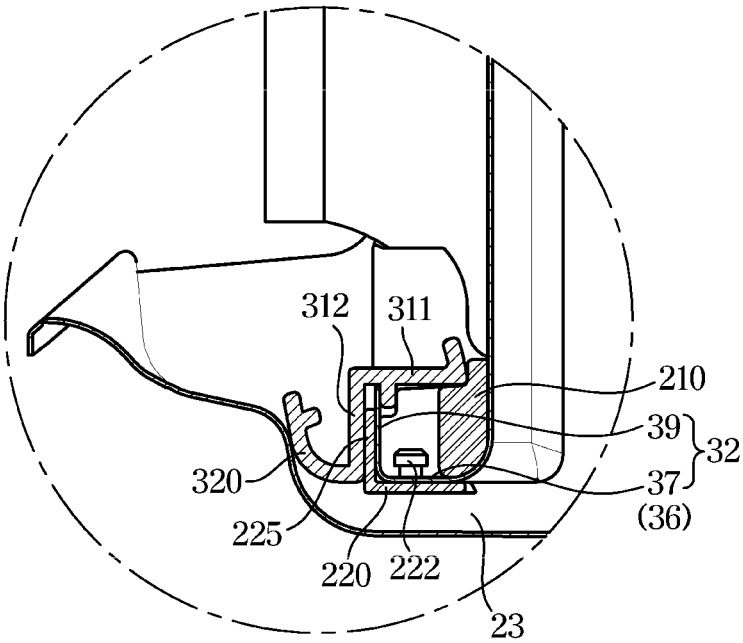
FIG. 9 is a cross-sectional view taken along line A-A' of FIG. 4.

FIG. 6 is a perspective view showing a state in which the cover member of FIG. 4 is coupled with the door, FIGS. 7A and 7B are enlarged perspective views showing the cover member of FIG. 4, FIG. 8 is a perspective view showing a state in which a sealing member is coupled with a door coupled with the cover member of FIG. 6, and FIG. 9 is a cross-sectional view taken along line A-A' of FIG. 4.

Referring to FIGS. 6 to 8, the cover member 200 may be coupled with or located at a side portion (the side panel 35) of the lower end of the inner door 32 before the sealing member 110 is coupled with the lower end of the inner door 32, and the sealing member 110 may be coupled with the second flange 39 after the cover member 200 is coupled with or located at the lower end of the inner door 32.

In this case, the cover member 200 may be accommodated between the first flange 37 and the second flange 39 while being coupled with the side panel 35 of the inner door 32 to cover a space between the side surface of the inner door 32 and the lower end of the inner door 32.

The cover member 200 may include a body portion 210, a first cover portion 230, and a second cover portion 220, wherein the body portion 210, the first cover portion 230, and the second cover portion 220 may be integrated into one body.

The body portion 210 may be positioned between the first flange 37 and the second flange 39. The first cover portion 230 may be connected to the body portion 210, extend upward from the body portion 210, and be coupled with the side panel 35. In this case, the side panel 35 may form the side surface of the inner door 32, and be located at a preset height from the bottom plate 21 of the tub 20 to form a space in which the first cover member 230 is coupled with the side panel 35.

Meanwhile, at an upper end of the first cover member 230, an opening 235 with which an end of the side panel 35 is coupled may be formed to accommodate the end of the side panel 35. More specifically, the first cover portion 230 may include, as shown in FIG. 7A, a first plate 231, a second plate 232 facing the first plate 231, and a third plate 233 provided between the first plate 231 and the second plate 232. Accordingly, at the upper end of the first cover portion 230, the opening 235 may be formed by the first plate 231, the second plate 232, and the third plate 233.

As described above, the body portion 210 may be accommodated between the first flange 37 and the second flange 39 formed in the lower end of the inner door 32, and the first cover portion 230 may be coupled with the side panel 35 of the door 30 to completely prevent washing water flowing along the bottom plate 21 of the tub 20 from leaking between the first and second flanges 37 and 39 and the side surface of the inner door 32. Particularly, the body portion 210 may be inserted between the first flange 37 and the second flange 39 and fixed to prevent the cover member 200 from being separated from the lower end of the inner door 32.

Meanwhile, the second cover portion 220 may be connected to one side of the body portion 210, and formed at a lower portion of the body portion 210. The second cover portion 220 may be coupled with the first flange 37 in a case in which the body portion 210 is positioned between the first flange 37 and the second flange 39 as described above. That is, in a case in which the body portion 210 is positioned on one surface of the first flange 37, the second cover portion 220 may be coupled with the other surface of the first flange 37.

In this case, the first flange 37 may form a coupling hole 36, and the second cover portion 220 may form a protrusion 222 for coupling with the coupling hole 36 on a surface facing the first flange 37. The second cover portion 220 may be coupled with the first flange 37 by passing the protrusion 222 through the coupling hole 36 formed in the other surface of the first flange 37. In this case, the second cover portion 220 may be positioned between the first flange 37 and the bottom plate 21 of the tub 20 to cover a gap between the first flange 37 and the bottom plate 21 of the tub 20.

Meanwhile, the second cover member 220 may be, as shown in FIGS. 7A and 7B, connected to an end of the body portion 210, and extend downward from the body portion 210 in such a way as to form a preset angle with respect to the body portion 210. In this state, the second cover portion 220 may move upward to be coupled with the first flange 37.

In this case, the second cover portion 220 may include a material having flexibility to easily move.

Also, the second cover portion 220 may include a protrusion rib 225 extending upward at one end, as shown in the drawings, and the protrusion rib 225 will be described below.

As described above, after the cover member 200 is coupled with or located at the lower end of the inner door 32, the sealing member 110 may be coupled with or located at the lower end of the inner door 32, as shown in FIG. 8.

The sealing member 110 may be provided in the lower end of the inner door 32 in such a way as to be in contact with the bottom plate 21 of the tub 20, to prevent washing water from moving toward the lower end of the inner door 32 from the bottom plate 21 of the tub 20. The sealing member 110 may include a first sealing portion 310 and a second sealing portion 320.

The first sealing portion 310 may have a cross section in a shape of '⊓', include a plastic material, and be coupled with the second flange 39. In this case, the second flange 39 may include the first hole 38, and the first sealing portion 310 may include a second hole 315 corresponding to the first hole 38. By overlapping the first hole 38 and the second hole 315 with each other and then passing a mechanical coupling member such as a rivet through the first hole 38 and the second hole 315, the first sealing portion 310 may be coupled with the second flange 39.

Meanwhile, such mechanical coupling between the first sealing portion 310 and the second flange 39 may be performed after the cover member 200 is accommodated between the first flange 37 and the second flange 39. At this time, the first hole 38 of the second flange 39 may be formed at a portion being adjacent to the accommodated cover member 200, and to pass the mechanical coupling member through the first hole 38, the first hole 38 may be spaced a preset distance from the cover member 200 to form a space for mechanical coupling.

Accordingly, again referring to FIGS. 7A and 7B, the body portion 210 may include a first body member 212 inserted between the first flange 37 and the second flange 39, and a second body member 214 having a narrower width than the first body member 212 and spaced a preset distance from the second flange 39. That is, the second body member 214 may be positioned between the first flange 37 and the second flange 39 to form an empty space, and accordingly, the mechanical coupling member may pass through the second hole 315 of the first sealing portion 310 and the first hole 38 of the second flange 39 to be positioned in the empty space.

Meanwhile, more specifically, the first sealing portion 310 may include a first seal 311 and a second seal 312.

The first seal 311 may extend along the second flange 39 and be coupled with one side of the second flange 39. That is, the first seal 311 may include the first hole 38 and be coupled with the second hole 315 of the second flange 39 through the mechanical coupling member.

The second seal 312 may extend from one end of the first seal 311 to face the first flange 37. The second seal 312 may include a guide rib 317 protruding on a surface facing the first flange 37. The second flange 39 may be inserted between the first seal 311 and the guide rib 317, and the first sealing portion 310 may be coupled with the inner door 32. That is, the first seal 311 may be coupled with one side of the second flange 39, and the guide rib 317 may be adhered to the other side of the second flange 39 to stably couple the first sealing portion 310 with the inner door 32.

Meanwhile, the second sealing portion 320 may be bent upward from one end of the first seal 311 to seal a gap between the bottom plate 21 of the tub 20 and the second flange 39.

That is, as shown in FIG. 9, the second sealing portion 320 may seal a gap between the second flange 39 and a portion bent upward from the bottom plate 21 of the tub 20, and accordingly, washing water moving along the bottom plate 21 of the tub 20 may be prevented from leaking out above the bent portion.

Furthermore, the second sealing portion 320 may be made of a rubber material, and accordingly, the second sealing portion 320 may be adhered to the bottom plate 21 of the tub 20, thereby performing sealing.

Meanwhile, in a case in which the sealing member 110 is coupled with the inner door 32 coupled with the cover member 200, as described above, the protrusion rib 225 of the second cover portion 220 may be inserted between the first seal 311 of the first sealing portion 310 and the second flange 39, as shown in FIG. 9. That is, the protrusion rib 225 may extend upward from one side of the second cover portion 220, as described above, and may be insertion-coupled between the first seal 311 and the second flange 39 to more stably couple the cover member 200 with the lower end of the inner door 32.

Figure 10A:
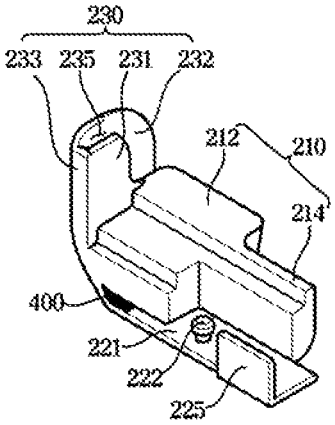
FIGS. 10A and 10B are perspective views showing a cover member in a dishwasher according to another embodiment of the disclosure.
Figure 10B:
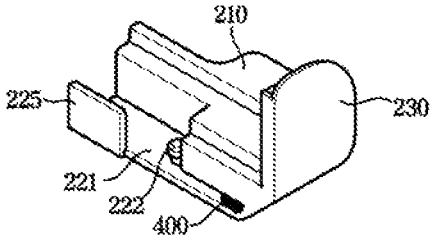

FIG. 10 is a perspective view showing a cover member in a dishwasher according to another embodiment of the disclosure.

Referring to FIG. 10, a cover member 200 according to an embodiment of the disclosure may have the same configuration as the cover member 200 described above with reference to FIGS. 6 and 7, except that a second cover portion 221 is parallel to a body portion.

The second cover portion 221 of the cover member 200 may be connected to an end of the body portion and extend parallel to the body portion. Also, the cover member 200 may include an elastic member 400 having elasticity, wherein the elastic member 400 is formed between the second cover portion 221 and the body portion at a portion at which the second cover portion 221 is connected to the body portion.

Therefore, to couple the sealing member 110 with the lower end of the inner door 32, the sealing member 110 may be coupled with the lower end of the inner door 32 after the second cover portion 221 moves downward, and after the sealing member 110 is coupled with the lower end of the inner door 32, the second cover portion 221 may again move upward to couple the protrusion 222 with the first flange 37. In this case, the second cover portion 221 may be maintained in parallel to the body portion by the elastic member 400 to easily couple the second cover portion 221 with the first flange 371.

The dishwasher according to a concept of the disclosure may prevent leakage by covering the gap between the inner door and the bottom of the tub.

Also, the dishwasher may prevent leakage at a portion that is not prevented from leakage by the sealing member by covering the gap between the inner door and the sealing member.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A dishwasher comprising:

a main body;

a tub provided inside the main body to form a washing space;

a door configured to open and close the tub, and including an inner door located inside the tub while the tub is closed by the door;

a sealing member provided at a lower end of the inner door, and configured to prevent leakage from occurring between a bottom plate of the tub and the inner door; and a cover member provided at the lower end of the inner door and to cover a gap between the lower end of the inner door and the tub, wherein the lower end of the inner door comprises:

a side panel formed to face a side surface of the tub, the cover member being coupleable to the side panel of the lower end of the inner door, a first flange formed to face the bottom plate of the tub, and a second flange formed to extend upward from the first flange, wherein the sealing member comprises:

a first sealing portion coupleable to the second flange, and a second sealing portion formed to be bent upward from the first sealing portion, and seal a gap between the bottom plate of the tub and the second flange, wherein the cover member comprises:

a body portion to be positioned between the first flange and the second flange, a first cover portion to be connected to the body portion, formed to extend upward, and coupleable to the side panel, and a second cover portion to be connected to one side of the body portion, coupleable to the first flange, and positioned between the bottom plate of the tub and the first flange.

2. The dishwasher of claim 1, wherein the second flange comprises a first hole, and the second sealing portion comprises a second hole formed at a location corresponding to the first hole.

3. The dishwasher of claim 1, wherein the first sealing portion comprises:

a first seal formed to extend along the second flange, and coupleable to one side of the second flange; and a second seal formed to extend from one end of the first seal to face the first flange, and including a guide rib adhered to another side of the second flange.

4. The dishwasher of claim 1, wherein an opening to accommodate an end of the side panel is formed at an upper end of the first cover portion.

5. The dishwasher of claim 4, wherein the first cover portion comprises:

a first plate;

a second plate formed to face the first plate; and a third plate provided between the first plate and the second plate.

6. The dishwasher of claim 1, wherein the first flange comprises:

a coupling hole, and a protrusion for coupling with the coupling hole is formed on a surface of the second cover portion, the surface formed to face the first flange.

7. The dishwasher of claim 6, wherein the second cover portion comprises:

a protrusion rib formed to be inserted and fixed between the first sealing portion and the second flange while the first sealing portion is coupled to the second flange.

8. The dishwasher of claim 1, wherein the body portion comprises:

a first body member formed to be inserted between the first flange and the second flange; and a second body member having a narrower width than the first body member, and spaced a preset distance from the second flange.

9. The dishwasher of claim 1, wherein the second cover portion includes a flexible material.

10. The dishwasher of claim 9, wherein while the second cover portion is connected to one end of the body portion, the second cover portion forms a preset angle with respect to the body portion.

11. The dishwasher of claim 9, wherein while the second cover portion is connected to one end of the body portion, the second cover portion extends parallel to the body portion.

* * * * *